United States Patent [19]

Peterson

[11] Patent Number: 4,545,084

[45] Date of Patent: Oct. 8, 1985

[54] MODULAR DRIVE ARRANGEMENT FOR ADJUSTABLE BEDS AND THE LIKE

[75] Inventor: Warren J. Peterson, Stevens Point, Wis.

[73] Assignee: Joerns Healthcare, Inc., Stevens Point, Wis.

[21] Appl. No.: 576,580

[22] Filed: Feb. 3, 1984

[51] Int. Cl.[4] ..... A61G 7/06

[52] U.S. Cl. ..... 5/69; 5/66; 74/625; 403/197; 403/239

[58] Field of Search ..... 5/68, 69, 67, 66, 60, 5/61, 62, 63, 64, 65; 403/197, 194, 239, 238

[56] References Cited

U.S. PATENT DOCUMENTS

| | | | |
|---|---|---|---|
| 2,560,465 | 7/1951 | McVicker et al. | 74/625 |
| 2,605,481 | 8/1952 | Burkhart | 5/69 |
| 2,617,117 | 11/1952 | Putterbaugh | 5/69 |
| 2,699,688 | 1/1955 | Sutton | 74/722 |
| 2,755,488 | 7/1956 | Fuhrer | 5/69 |
| 3,012,253 | 12/1961 | Reichert | 5/68 |
| 3,096,106 | 7/1963 | Wanner | 403/197 |
| 3,174,161 | 3/1965 | Black | 5/68 |
| 3,281,873 | 11/1966 | Stanley et al. | 5/68 |
| 3,581,319 | 6/1971 | Stanley et al. | 5/68 |
| 3,593,350 | 7/1971 | Knight et al. | 5/66 |
| 3,797,273 | 3/1974 | Benoit et al. | 64/4 |
| 3,898,702 | 8/1975 | Goodman | 5/68 |
| 3,972,081 | 8/1976 | Stern et al. | 5/68 |
| 4,271,545 | 6/1981 | Christian, III | 5/66 |
| 4,324,010 | 4/1982 | Houlberg et al. | 5/68 |
| 4,376,316 | 3/1983 | Mercier et al. | 5/66 |
| 4,381,571 | 4/1983 | Elliott | 5/66 |

*Primary Examiner*—Alexander Grosz

*Attorney, Agent, or Firm*—Price, Heneveld, Huizenga & Cooper

[57] ABSTRACT

A modular drive arrangement for adjustable beds, and the like, comprises interchangeable motor drive units, and manual crank units. The motor drive units have an output shaft at one end, with a coupling that releasably connects with the controller shafts of the bed to manipulate the adjustable sections of the bed. A first, quick-disconnect latch member is located on the bed frame, and mates with a second, quick-disconnect latch member on the opposite end of each motor drive unit to support the motor drive units on the bed frame. The manual crank units have a coupling at one end, which releasably connects with the controller shafts to rotate the same. The opposite end of each manual crank unit includes a bearing, with a third, quick-disconnect latch member thereon, which also mates with the first quick-disconnect latch member to support the manual crank units on the bed frame, whereby even relatively unskilled personnel, without tools, can remove a motor drive unit from the bed for off-site repair, and replace the same with a manual crank unit to insure uninterrupted operation of the bed, without disturbing the patient.

35 Claims, 13 Drawing Figures

FIG. 4
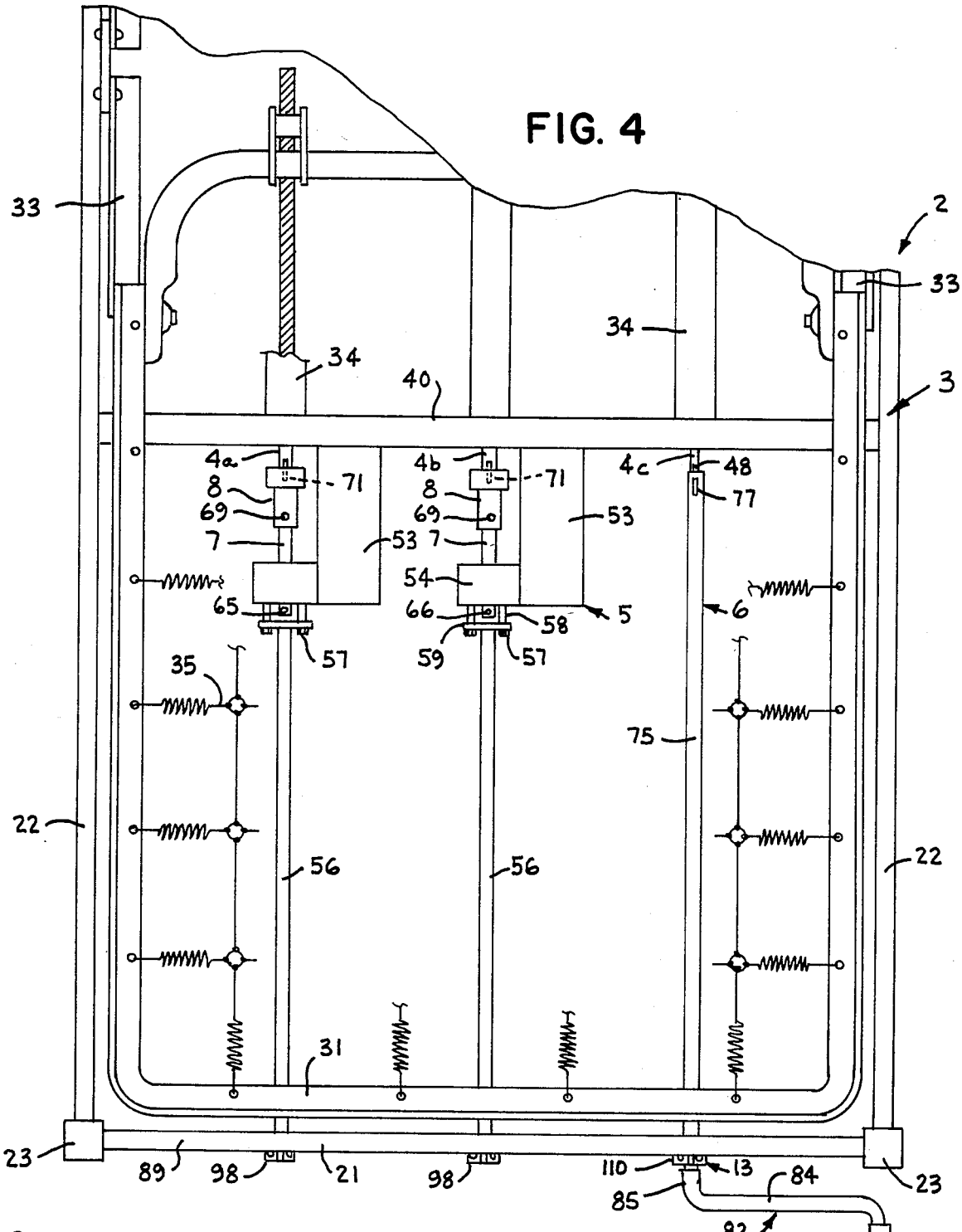
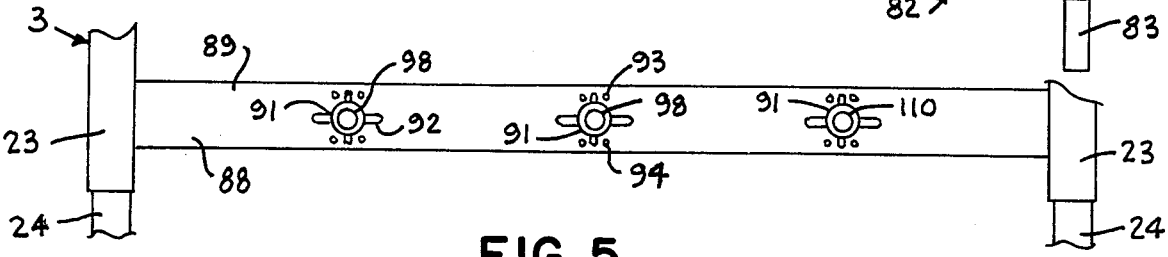
FIG. 5

MODULAR DRIVE ARRANGEMENT FOR ADJUSTABLE BEDS AND THE LIKE

BACKGROUND OF THE INVENTION

The present invention relates to adjustable beds, and the like, and in particular to a modular drive arrangement therefor.

Adjustable beds are used extensively in hospitals, nursing homes, and other similar institutions, as well as home care settings, to assist in the care and treatment of invalids. Normally, each adjustable section of the bed has a separate controller shaft, which when rotated, moves the adjustable bed section to the desired height and attitude. Manual beds have one or more cranks to rotate the various controller shafts, whereas powered beds have at least one electric motor, and some type of transmission to operate the different functions of the bed.

Heretofore, those adjustable beds which have been designed for home care, have typically been of the manual type, in order to minimize costs, and to avoid the maintenance and repair problems associated with motorized adjustable beds, which are mechanically quite complicated, compared to manual beds. Home care beds are preferably very compact and lightweight so that they can be easily transported, such as to and from rental stores handling medical equipment. Further, home care beds should be extremely durable, and easy to operate, even by unskilled personnel. It is also preferred that home care beds be powered by electric motors, or the like, so that they can be adjusted by persons having limited physical strength or dexterity, so that the patient can be cared for by even elderly persons, such as a spouse or relative.

SUMMARY OF THE INVENTION

One aspect of the present invention is a modular drive arrangement for adjustable beds of the type having a frame, and a controller shaft that is rotated to manipulate an adjustable portion of the bed. The modular drive arrangement comprises a motor drive unit, having first and second ends, with an output shaft protruding from the first end of the motor drive unit. A first coupling member is located on the controller shaft of the bed, and a second coupling member is located on the output shaft of the motor drive unit. The first and second coupling members mate with one another to releasably and selectively interconnect the output shaft of the motor drive unit with the controller shaft of the bed, and transmit rotary motion therebetween. Means are provided for preventing relative rotation between the motor drive unit and the bed frame during adjustment of the bed. A first, quick-disconnect latch member is located on the bed frame, and a second, quick-disconnect latch member is located on the second end of the motor drive unit, and mates with the first quick-disconnect latch member to selectively support the motor drive unit on the bed frame. The modular drive arrangement also includes a manual crank unit, having first and second ends, with a handle protruding from the second end of the manual crank unit. A third coupling member is located on the first end of the manual crank unit, and is shaped to mate with the first coupling member to releasably interconnect the manual crank unit with the controller shaft of the bed and transmit rotary motion therebetween. A bearing is located on the second end of the manual crank unit, and has a third quick-disconnect latch member thereon, which mates with the first quick-disconnect latch member to selectively and rotatably support the manual crank unit on the bed frame, whereby even relatively unskilled personnel, without tools, can remove the motor drive unit from the bed for off-site repair, and replace the same with the manual crank unit to insure uninterrupted operation of the bed, without disturbing the patient.

The quick-disconnect latch members are preferably located at the foot of the bed, and include lock bushings which form a unique snap-lock with the bed frame. An emergency crank is also provided to manually operate a motor drive unit when electricity is not available, without removing the motor drive unit from the bed.

Another aspect of the present invention comprises an improved quick-disconnect mounting arrangement for the drive units of adjustable beds. The mounting arrangement comprises a coupling connected with one end of the drive unit, including a socket in which the controller shaft is closely received, thereby supporting one end of the drive unit on the bed frame. The coupling and the controller shaft include a key arrangement which rotatably interconnects that end of the drive unit with the controller shaft to transmit rotary motion therebetween. A quick-disconnect latch releasably connects the opposite end of the drive unit with a foot portion of the bed frame. The quick-disconnect latch comprises an aperture extending through a vertical wall portion of the frame foot section, with the aperture having at least one radially oriented slot. At least one pair of laterally spaced apart stops protrudes outwardly from the exterior side of the vertical wall portion of the frame foot section, a spaced apart, angular measure from the slot. A lock bushing is rotatably mounted on the opposite end of the drive unit, and includes a cylindrically-shaped body with at least one ear protruding radially outwardly therefrom. The bushing ear is shaped for longitudinal insertion into the slot, and has a radially extending notch, which has a width slightly greater than the thickness of the vertical wall portion of the frame foot section, and divides the ear into forward and rearward halves. To lock the drive unit onto the bed frame, the lock bushing is rotated until the forward half of the lock bushing ear is positioned between the stops to define a snap-lock, which can be easily operated by even relatively unskilled personnel, without tools, to remove and replace the drive unit.

The principal objects of the present invention are to provide an improved drive arrangement for adjustable beds and the like, which has modular motor drive units and manual crank units that can be easily interchanged by even unskilled personnel, without the need for any tools whatsoever. The modular drive arrangement has a very uncomplicated construction, which is lightweight and durable. A quick-disconnect mounting arrangement for the motor drive units and the manual crank units enables the user, or a non-technical assistant, to easily remove and replace broken or worn-out motor drive units from the bed, so that the non-functioning units can be transported to a local repair facility, thereby avoiding the cost of service calls by trained mechanics. Furthermore, the quick-disconnect mount enables the user to replace non-operative motor drive units with a manual crank unit to insure uninterrupted operation of the bed. Both the motor drive units and the manual crank units are mounted in such a manner that they can be removed and replaced without disturbing the patient or his bedding. When the bed is temporarily moved to a location where electrical power is not accessible, an emergency crank is provided to move the motor driven sections of the bed, without removing the motor drive units. The present modular drive arrangement is efficient in use, economical to manufacture, capable of a long operating life, and particularly well adapted for the proposed use.

These and other features, advantages, and objects of the present invention will be further understood and appreciated by those skilled in the art by reference to the following written specification, claims and appended drawings.

BRIEF DESCRIPTION OF THE DRAWINGS

FIG. 4 is a fragmentary, top plan view of the adjustable bed, with two motor drive units, and one manual crank unit installed therein.

FIG. 5 is a fragmentary, front elevational view of a foot portion of the bed.

DETAILED DESCRIPTION OF THE PREFERRED EMBODIMENTS

Figure 1:
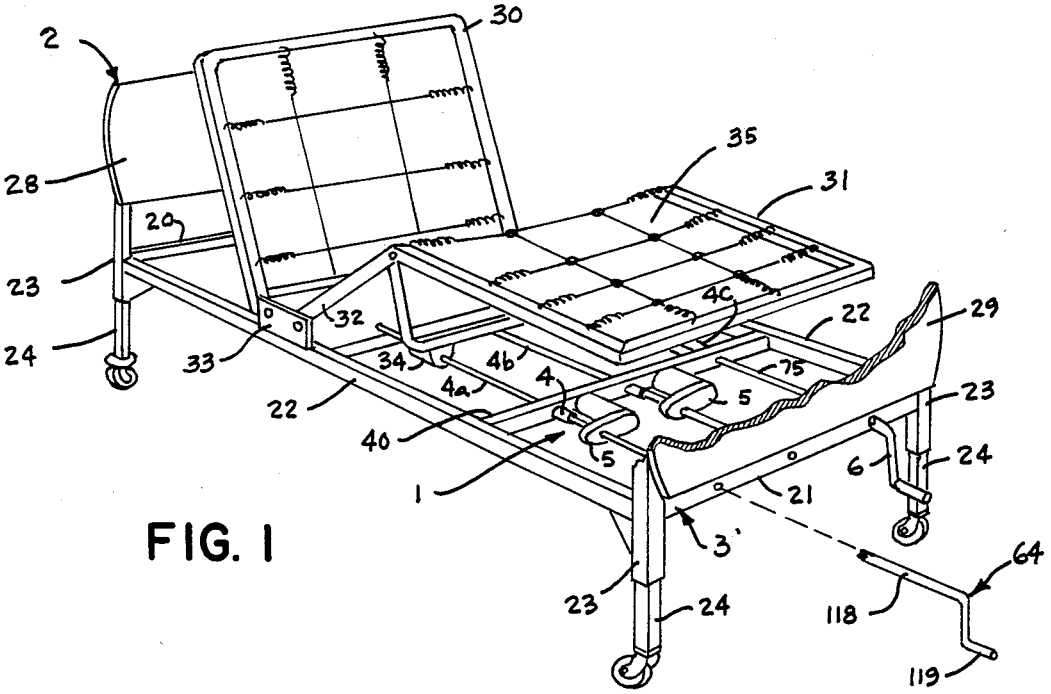
FIG. 1 is a partially schematic, perspective view of an adjustable bed, having a modular drive arrangement embodying the present invention, wherein a portion of the bed has been broken away to reveal internal construction.

For purposes of description herein, the terms "upper," "lower," "right," "left," "rear," "front," "vertical," "horizontal," and derivatives thereof shall relate to the invention as oriented in FIGS. 1 and 4. However, it is to be understood that the invention may assume various alternative orientations, except where expressly specified to the contrary.

The reference numeral 1 (FIG. 1) generally designates a modular drive arrangement embodying the present invention. Modular drive arrangement 1 is designed for use in conjunction with adjustable beds and the like, such as the illustrated bed 2, which has a frame 3, and controller shafts 4 that are rotated to manipulate the adjustable portions of bed 2. Modular drive arrangement 1 comprises interchangeable motor drive units 5, and manual crank units 6. The motor drive units 5 (FIG. 2) have an output shaft 7 at one end, with a coupling 8, which releasably connects with the controller shafts 4 of bed 2. A first, quick-disconnect latch member 9 is located on bed frame 3, and mates with a second, quick-disconnect latch member 10 on the opposite end of each motor drive unit 5 to support the motor drive units 5 on bed frame 3. The manual crank units 6 (FIG. 3) have a coupling 11 at one end which releasably connects with controller shafts 4 to rotate the same. The opposite end of each manual crank unit 6 includes a combination bearing and third, quick-disconnect latch member 13, which also mates with the first quick-disconnect latch member 9 to support the manual crank units 6 on bed frame 3. The quick-disconnect latches 9, 10 and 13 permit even relatively unskilled personnel, without any tools, to remove a motor drive unit 5 from bed 2 for off-site repair, and replace the same with a manual crank unit 6 to insure uninterrupted operation of the bed, without disturbing the patient.

The illustrated adjustable bed 2 (FIG. 1) has a generally conventional construction, except as noted otherwise herein. Bed frame 3 includes a head section 20, a foot section 21, and opposite side sections 22. The four corners of bed frame 3 include a square, vertically oriented channel 23 in which an adjustable leg 24 is slidingly received and supported. Each adjustable leg 24 is operably connected with the center controller shaft **4*b* through a cable and pulley arrangement (not shown), such that rotation of center controller shaft 4*b* raises and lowers bed 2**.

A headboard 28 and a footboard 29 are attached to the upper ends of the leg channels 23 of bed frame 3. The illustrated bed 2 has three separately adjustable functions, including a pivoting head gatch 30, a pivoting foot gatch 31 and associated center gatch 32, and adjustable legs 24, which were previously described. Side support plates 33 pivotally attach the marginal frame portions of the head and center gatch sections 30 and 32 to the side sections 22 of the main frame 3. In the illustrated example, conventional screw jacks 34 are used to control the attitude of the head gatch 30, and foot and center gatches 31 and 32. Rotation of the left-hand controller shaft **4*a* pivots the head gatch 30, and rotation of the right-hand controller shaft 4*c* manipulates the foot and center gatches 31 and 32. A conventional spring-wire mattress support 35 covers the head, center and foot gatches 30–32**.

Figure 2:
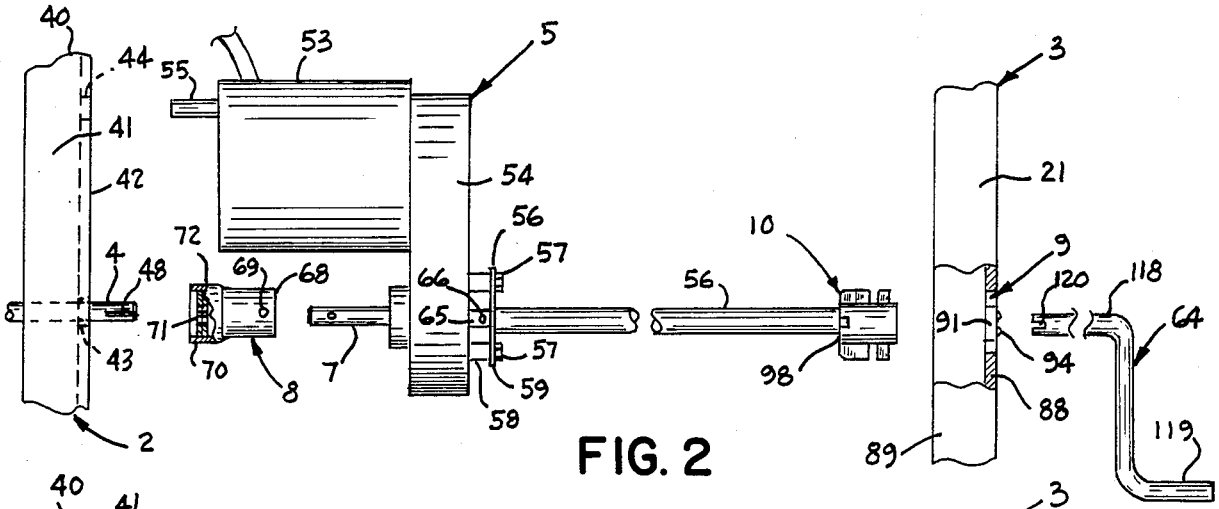
FIG. 2 is an exploded, fragmentary, top plan view of a motor drive unit, shown disassembled from the bed frame.
Figure 3:
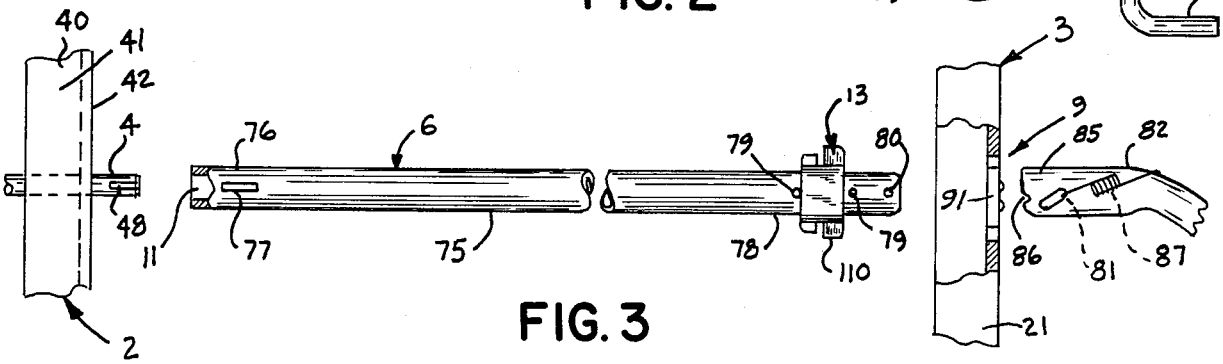
FIG. 3 is an exploded, fragmentary, top plan view of a manual crank unit, shown disassembled from the bed frame.

Bed frame 3 also includes a laterally extending cross brace 40, which is positioned at a medial portion of the bed frame, and has its ends fixedly connected with the opposite frame side sections 22. The illustrated cross brace 40 is spaced from foot frame section 21 a distance that is substantially equal to one-third of the length of bed frame 3. The medial positioning of cross brace 40 minimizes the size of the screw jacks 34, and helps reduce manufacturing costs, overall weight, and centralized weight distribution. As best illustrated in FIGS. 2 and 3, cross brace 40 comprises a section of C-shaped steel channel having upper and lower horizontal faces or flanges 41, and a vertical wall or flange 42. The vertical flange 42 of cross brace 40 includes three horizontally oriented apertures 43 therein, which act as journals, through which the ends of controller shafts 4 extend. The vertical flange 42 of cross brace 40 also includes three apertures or sockets 44, which are spaced apart from the associated controller shaft journals 43, and are oriented parallel therewith for purposes to be described in greater detail hereinafter.

Each of the controller shafts 4*a*, 4*b* and 4*c* comprise a solid rod, which extends outwardly from the vertical flange 42 of cross brace 40 toward the foot section 21 of bed 2. Each controller shaft 4 has two keyways 48, which are located at the terminal end of the controller shaft, and are oriented in a substantially parallel relationship with the longitudinal axis of the controller shaft. The controller shaft keyways 48 are positioned 180 degrees apart on the circumference of the controller shafts 4, and are adapted to mate with the two couplings 8 and 11, so as to transmit rotation from the motor drive units 5 and the manual crank units 6 to the controller shafts 4.

Each of the motor drive units 5 associated with adjustable bed 2 is substantially identical in construction, as are the various manual crank units 6. Hence, to avoid duplication, the description of the invention herein shall be limited to one motor drive unit 5, and one manual crank unit 6.

Each motor drive unit 5 comprises an electric motor 53, with a speed reducer 54 connected with the foot end of the motor. A stud 55 is attached to the head end of electric motor 53, and is shaped to be closely received in mating socket 44, so as to prevent rotation between motor drive unit 5 and bed frame 3 when the motor is in operation. Speed reducer 54 includes laterally offset output shaft 7 extending toward the head end 20 of the bed frame 3. A support arm 56 is attached to the foot side of speed reducer 54 by a pair of bolts 57 and mating spacers 58. Support arm 56 includes a base plate 59 that is secured to the housing portion of speed reducer 54 by bolts 57.

Figure 6:
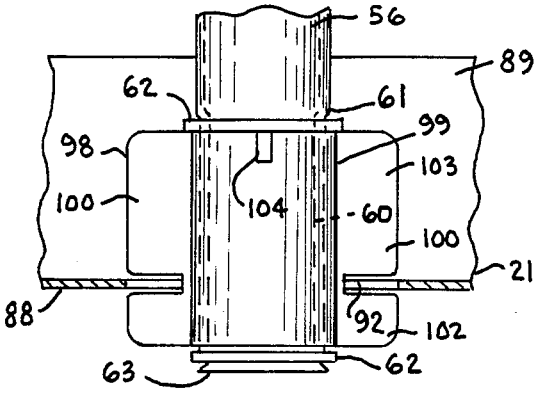
FIG. 6 is a top plan view of a first lock bushing, connected with a foot end of the motor drive unit, and shown in an unlocked position on the bed frame.
Figure 7:
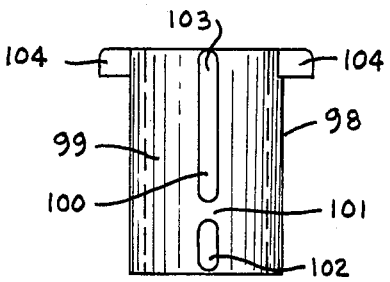
FIG. 7 is a side elevational view of the first lock bushing shown in FIG. 6.
Figure 8:
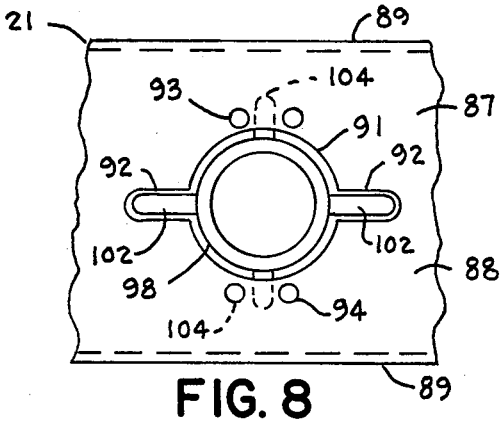
FIG. 8 is a front elevational view of the first lock bushing, shown in the unlocked position on the bed frame.
Figure 9:
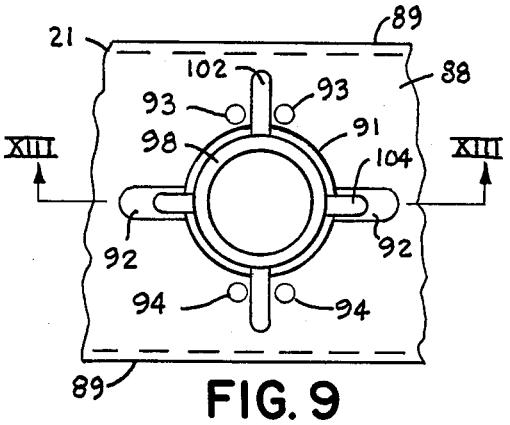
FIG. 9 is a front elevational view of the first lock bushing, shown in a locked position on the bed frame.
Figure 10:
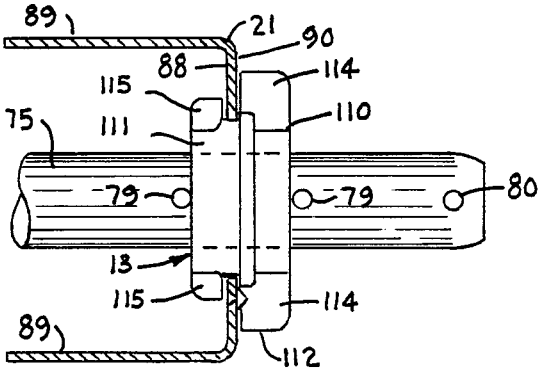
FIG. 10 is a side elevational view of a second lock bushing, connected with a rearward end of the manual crank unit, and shown in a locked position on the bed frame.
Figure 11:
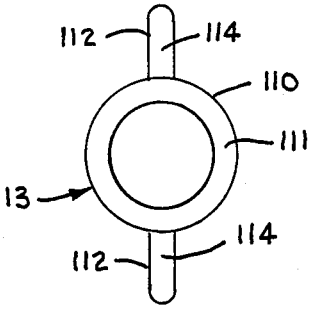
FIG. 11 is a front elevational view of the second lock bushing.
Figure 12:
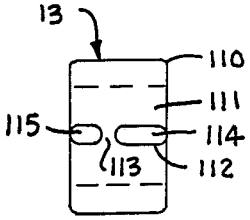
FIG. 12 is a side elevational view of the second lock bushing.

The second quick-disconnect latch member 10 (FIG. 2) is rotatably attached to the foot end of support arm 56. The illustrated support arm comprises a hollow, cylindrical tube, having the head end thereof welded, or otherwise fixedly attached to base plate 59. As best illustrated in FIG. 6, the foot end of support arm 56 includes a journal portion 60, having a reduced diameter, and a trailing shoulder 61. The second quick-disconnect latch member 10 is rotatably retained on the journal portion 60 of support arm 56 between a pair of washers 62. The terminal end 63 of support arm 56 is enlarged, by means such as swaging, or the like, thereby fixing the longitudinal position of latch member 10 on support arm 56.

Motor support arm 56 is designed to receive an emergency crank 64 therein, so that electric motor 53 can be manually rotated to adjust the various bed functions in the event that electrical power is temporarily unavailable. Emergency crank 64, which is described in detail hereinafter, can be used if there is a sudden power outage in the building, or if the adjustable bed 2 is temporarily moved away from an accessible power outlet, such as when the bed is positioned in a hospital corridor, or the like. An auxillary shaft 65 protrudes from the foot side of speed reducer 54, and is positioned concentric with the hollow motor support arm 56. A connector pin 66 extends radially through auxiliary shaft 65 to connect with emergency crank 64.

Coupling 8 (FIG. 2) comprises a sleeve having a foot end 68 attached to the output shaft 7 of motor drive unit 5 by a pin 69. The head end 70 of coupling 8 has a slightly greater outside diameter than foot end 68, and includes a cylindrical aperture, which is shaped to be closely received over the control shafts 4. A pair of radially inwardly extending splines 71 are provided in the head end 70 of coupling 8, and are shaped to be received in the keyways 48 on controller shafts 4. In the example illustrated in FIG. 2, the head end 70 of coupling 8 is hollow, and includes six, circumferentially spaced apart grooves on the interior surface thereof. Mating drive discs 72, with radially outwardly extending tabs that are closely received in the matching grooves, are inserted into the hollow, head end 70 of coupling 8. Drive discs 72 have a center aperture in which controller shafts 4 is received, and include the two splines 71 which interconnect with keyways 48. The drive discs 72 transmit torque from coupling 8 to controller shafts 4, and assist in electrically isolating the motor drive unit 5 from bed frame 3, as explained below.

The motor drive units 5 are preferably electrically insulated from bed frame 3 to alleviate transmitting electrical leakage from electric motor 53. In the illustrated example, coupling 8 is constructed of a non-conductive material, such as nylon. Hence, drive discs 72 can be constructed of metal for improved wear and strength, since nylon coupling 8 will electrically insulate the output shaft 7 of motor drive unit 5 from controller shaft 4 and bed frame 3. Also, motor stud 55 preferably includes a non-conductive coating or exterior bushing which electrically insulates this point of contact on motor drive unit 5 from bed frame 3. Finally, latch member 10 is also preferably made from a non-conductive material, such as nylon, so that all three points of contact between the motor drive units 5 and the bed frame 3 are electrically insulated.

The illustrated manual crank unit 6 (FIG. 3) comprises a cylindrically-shaped, hollow, rectilinear tube 75, having a substantially uniform cross-sectional shape which permits crank tube 75 to be inserted into bed 2 from the exterior side of the foot frame section 21, as described below. The head end 76 of crank tube 75 is shaped for close reception on the outer surface of the controller shafts 4. A pair of keys 77 project radially inwardly from the interior surface of the tube end 76, on diametrically opposite sides thereof, and are shaped to mate with the keyways 48 on controller shafts 4. Bearing 12 is rotatably mounted on the foot end 78 of crank tube 75, and is retained in place longitudinally by a pair of pins 79. A third pin 80 extends diametrically through the terminal portion of the foot end 78 of crank tube 75, and is adapted to mate with a latch 81 on removable crank 82. Removable crank 82 (FIG. 4) is generally Z-shaped, and includes a handle 83, a medial portion 84, and a base 85. The exterior end of base 85 is hollow, and is adapted to be closely received over the foot end 78 of tube 75. A notch 86 (FIG. 3) is provided on the outer edge of the crank base 85, and is shaped to receive the outer one of the retainer pins 79 therein. A spring 87 is mounted in the interior of the crank base 85, and urges latch 81 into a normally locked position with pin 80 to releasably retain crank 82 in place.

The foot section 21 (FIGS. 6 and 8–10) of bed frame 3 comprises a C-shaped channel, having a vertical, center wall 88, and upper and lower, horizontal flanges 89. The horizontal flanges 89 of frame foot section 21 extend toward the head end of bed 2, thereby defining a generally flat, exterior surface 90 from which the three quick-disconnect latch members 9, 10 and 13 are manipulated, as described hereinafter.

With reference to FIGS. 6–13, the first quick-disconnect latch member 9 comprises an aperture 91 extending through the vertical wall 87 of frame foot section 21. Aperture 91 has a generally circular, front elevational shape, with oppositely oriented, elongated slots 92 extending in a generally horizontal direction. In this example, aperture 91 is on center with the longitudinal centerline of frame foot section 21, and slots 92 are aligned, and have their longitudinal centerline extending through the center of aperture 91, which are spaced along the length of foot section 21 at preselected locations.

Figure 13:
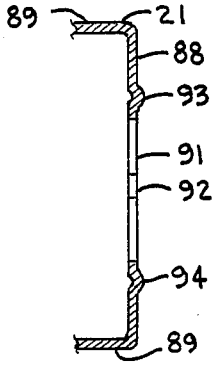
FIG. 13 is a cross-sectional view of the bed frame, taken along the line XIII—XIII of FIG. 9.

Two pairs of stops 93 and 94 respectively, protrude outwardly from the exterior surface 90 of the vertical wall 87 of foot section 21. The stops 93 and 94 in each pair are laterally spaced apart, and the stops are positioned at a preselected, spaced apart angular measure from the slots 92. The illustrated stops 93 and 94 comprise hemispherically-shaped bosses or knobs, and are oriented vertically, perpendicular to the horizontal axis of slots 92. As best illustrated in FIG. 13, stops 93 and 94 are stamped into the vertical wall 86 of foot section 21.

The second quick-disconnect latch member 10 (FIGS. 6–9) comprises a lock bushing 98 rotatably mounted on the foot end of support arm 56, in the manner described hereinabove. Lock bushing 98 comprises a cylindrically-shaped body 99, with a pair of diametrically opposed wings or ears 100 protruding radially outwardly from opposite sides of the body. The outside diameter of lock bushing body 99 is slightly less than the diameter of aperture 91, and the thickness of lock bushing ears 100 is slightly less than the width of slots 92. The overall width of both of the lock bushing ears 100 is slightly less than the total length of slots 92, such that the entire lock bushing 98 can be bodily inserted into one of the apertures 91 in the foot section 21 by longitudinal motion. Lock bushing ears 100 include radially extending notches 101, which have a width slightly greater than the thickness of the vertical wall 87 of foot section 21. Notches 101 divide both ears 100 into forward and rearward halves 102 and 103, respectively. The lock bushing ear notches 101 are longitudinally positioned on the lock bushing 98, such that when the motor drive unit 5 is properly assembled in the bed 2, the ear notches 101 are aligned with the vertical wall 87 of foot section 21. In this example, ear notches 101 extend all the way to the exterior surface of the lock bushing body 99.

A pair of stops 104 protrude radially outwardly from opposite sides of the head end of lock bushing 98, and are designed to abut the interior surface of vertical frame wall 87 when the latch is unlocked, to facilitate installation of motor drive unit 5, as described in greater detail hereinafter. Preferably, lock bushing 98 is molded from a self-lubricating, resilient material, such as nylon or the like, to reduce wear, and facilitate a secure snap-lock.

Once a motor drive unit 5 is properly positioned in bed 2, as described below, the motor drive unit is locked onto bed frame 2 as follows. The ears 100 of lock bushing 98 are initially aligned with slots 92. Lock bushing 98 is then rotated 90 degrees, until the forward halves 102 of lock bushing ears 100 are positioned between an associated pair of stops 93 and 94 to define a snap-lock. Lock bushing ears 100 provide a convenient surface to grasp, such that the lock bushing 98 is rotated like a wing nut. As soon as the ears 100 of lock bushing 98 are rotated past slots 92, the opposite, inwardly facing surfaces of the forward and rearward halves 102 and 103 of ears 100 capture the associated portion of the vertical wall 87 therebetween, so as to longitudinally position the motor drive unit on the frame. The stops 93 and 94 in each pair are spaced laterally apart a distance slightly greater than the width of ears 100, and protrude outwardly from the exterior surface 90 of vertical wall 87 a distance sufficient to engage the outer halves 102 of lock bushing ears 100. Since bushing ears 100 are resilient, they deform slightly outwardly as they engage the arcuate, cam-like out surfaces of the stops 93 and 94. When the bushing ears 100 pass over the centers of hemispherical stops 93 and 94, they elastically snap back into their undeformed shape, between the stop pairs, and thereby retain lock bushing 98 in the locked position.

Emergency crank 64 (FIGS. 1 and 2) can be used to manipulate the adjustable bed sections that are motor driven, without removing the motor drive unit 5 from bed 2. Emergency crank 64 comprises an elongate, cylindrical shaft 118, having an L-shaped handle 119 located at the outer end. The crank shaft 118 is shaped to be slid longitudinally into the hollow motor arm 56. The inner end of crank shaft 118 includes a notch 120 which mates with the connector pin 66 on auxillary speed reducer shaft 65 to transmit rotational motion therebetween. A spring-loaded ejector (not shown) is preferably provided at the slotted end of crank shaft 118 to rotationally disengage emergency crank 64 from auxillary shaft 65 automatically when the emergency crank is not being used. When emergency crank 64 is inserted into a motor drive unit 5, the hollow support arm 56 acts as a guide to position the slotted end 120 of crank shaft 118 on auxillary shaft 65, and rotation of the emergency crank will rotate the controller shaft 4, through the speed reducer 54 and electric motor 53.

The combination bearing and third quick-disconnect latch member 13 (FIGS. 10–12) are rotatably mounted on the foot end of crank tube 75 by retainer pins 79, as already described above. The third quick-disconnect latch member 13 comprises a second lock bushing 110, which is generally similar in shape and purpose to the first lock bushing 98. Lock bushing 110 includes a cylindrically-shaped body 111, with a pair of diametrically opposed ears 112 protruding radially outwardly therefrom. The outer diameter of lock bushing 111 is slightly smaller than the diameter of aperture 91, and the thickness of ears 112 is slightly smaller than the width of slots 92. The overall width of the rearward portion of ears 112 is slightly less than the total length of slots 92, such that the rearward portion of lock bushing 110 can be longitudinally inserted into aperture 92 from the exterior side of foot section 21, with a longitudinal motion. The ears 112 of second lock bushing 110 include notches 113, which have a width slightly greater than the thickness of vertical wall 87 of foot section 21, and divide both ears 112 into forward and rearward halves 114 and 115. Notches 113 are positioned longitudinally on ears 112, such that when the manual crank unit 6 is properly positioned in bed 2, the notches 113 align with the aperture slots 92. Preferably, notches 113 extend to the exterior surface of lock bushing body 111, and lock bushing 111 is integrally molded from a resilient, self-lubricating material, such as nylon, or the like.

The forward halves 114 of lock bushing ears 112 have an overall width which is greater than the total width of slots 92, so as to form a stop, which prevents lock bushing 110 from being pushed through the aperture 92 from the exterior side of foot section 21. The enlarged forward halves 114 of bushing ears 112 about the exterior surface 90 of foot section 21, and longitudinally position the manual crank unit 6 in bed 2.

After the manual crank unit 6 has been properly positioned in bed 2, it is locked onto bed frame 3 in the following manner. Initially, the ears 112 of lock bushing 110 are aligned with slots 92. Lock bushing 110 is then rotated 90 degrees, until the forward halves 114 of the lock bushing ears 112 are positioned between an associated pair of stops 93 and 94 to define a snap-lock.

In operation, the motor drive units 5, and the manual crank units 6 are installed in and removed from adjustable bed 2 in the following manner. In the event that a motor drive unit fails to operate properly, it is removed from the bed by first rotating the associated lock bushing 98 ninety degrees, until ears 100 are aligned with aperture slot 92. The user then pushes the subject motor drive unit 5 toward the head of the bed, until the end of lock bushing 98 clears the rear edge of the frame foot section 21. Next, the foot end of the subject motor drive unit 5 is lowered, so that it will pass underneath the frame foot section 21. The motor drive unit 5 is then pulled toward the foot of the bed, thereby disengaging the connection between coupling 8 and controller shaft 4, and simultaneously withdrawing stud 55 from socket 44. The head end of the motor drive unit 5 is then lowered, and the entire motor drive unit is withdrawn from underneath the bed.

In the event that a replacement motor drive unit is available on site, the new motor drive unit 5 can be immediately installed in the bed in the following manner, without disturbing the patient or the bedding. The new motor drive unit 5 is placed underneath bed 2, in a position generally aligned with the controller shaft 4 of the associated bed function. The foot end of the new drive motor unit 5 is pulled rearwardly, and with the lock bushing ears 100 aligned with the aperture slot 91, lock bushing 98 is inserted into aperture 91 until stops 104 engage the interior surface of vertical frame wall 87. The head end of the motor drive unit 5 is then raised to an elevation substantially commensurate with the height of controller shaft 4, and the entire unit is moved forwardly, toward the head of the bed, until the forward end of coupling 8 is received on controller drive shaft 4. Simultaneously, the stud 55 on motor drive unit 5 is aligned with, and inserted into mating socket 44. Coupling 8 is then rotated slightly, until the internal splines 71 are aligned with the mating keyway 48 in controller shaft 4. Drive motor unit 5 is then moved forwardly, fully engaging coupling 8 on controller shaft 4, until the notches 101 in lock bushing ears 100 are aligned with aperture 91. The installer may then grasp the rear halves 103 of lock bushing ears 100 from underneath bed 2, and rotate lock bushing 98 several degrees, so as to temporarily hold the motor drive unit in place. From the foot end of bed 2, lock bushing 98 is then rotated into the fully locked position, until the forward ears 102 are snapped into place between adjacent pairs of stops 93 and 94.

It is to be noted that the motor drive units 5 are completely interchangeable. Hence, in home care environments, should the head gatch drive unit fail to function for some reason, the motor drive unit from either the knee gatch or the high-low function can be removed and installed on the head gatch function as a temporary repair. In institutional settings, a motor drive unit from an unoccupied bed can be used to replace a non-functioning drive unit.

In the event that a spare drive motor unit 5 is not immediately available on site, to prevent interrupting the use of bed 2, a manual crank unit 6 may be installed in the bed as follows. The forward end 76 of crank tube 75 is inserted through aperture 91, until the forward end of the tube is received over controller shaft 4. Crank tube 76 is then rotated slightly, until keys 77 align with keyways 48. Next, crank tube 76 is moved forwardly until the notches 113 on lock bushing ears 112 are aligned with vertical frame wall 21. The enlarged, forward halves 114 of lock bushing ears 112 will prevent the crank tube 75 from being pushed too far forward onto controller shaft 4. Lock bushing 110 is then rotated 90 degrees, until the forward ears 114 are snapped into place between adjacent pairs of stops 93 and 94. Removable crank 82 is then assembled on the free, forward end of crank tube 75.

Manual crank unit 6 can be removed from bed 2 by simply reversing the installation steps outlined above.

All of the motor drive units 5 on adjustable bed 2 can be readily removed, and replaced with manual crank units 6 to make the bed completely manual for special applications, such as for pediatric patients, and the like, where power adjustment is not recommended.

The modular construction of the motor drive units 5 and manual crank units 6 permits them to be easily interchanged for repair and replacement, so as to insure uninterrupted operation of the bed, without disturbing the patient. The unique snap-lock mounting arrangement permits the motor drive units 5 and manual crank units 6 to be installed in and removed from the bed 2 by unskilled personnel, without the need for any tools whatsoever. The modular drive arrangement is uncomplicated, lightweight, durable, and particularly adapted for use in conjunction with home care adjustable beds.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. In an adjustable bed of the type having a frame, and a controller shaft that is rotated to manipulate an adjustable portion of said bed, the improvement of a modular drive arrangement, comprising:

a motor drive unit, having first and second ends, with an output shaft protruding from the first end of said motor drive unit;

a first coupling member located on the controller shaft of said bed;

a second coupling member located on the output shaft of said motor drive unit, and shaped to mate with said first coupling member to releasably and selectively interconnect the output shaft of said motor drive unit with the controller shaft of said bed and transmit rotary motion therebetween;

means for preventing relative rotation between said motor drive unit and said bed frame during adjustment of said bed;

a first, quick-disconnect latch member located on said bed frame;

a second, quick-disconnect latch member located on the second end of said motor drive unit, and shaped to mate with said first quick-disconnect latch member to selectively support said motor drive unit on said bed frame;

a manual crank unit, having first and second ends, with a handle protruding from the second end of said manual crank unit;

a third coupling member located on the first end of said manual crank unit, and shaped to mate with said first coupling member to releasably interconnect said manual crank unit with the controller shaft of said bed and transmit rotary motion therebetween;

a bearing located on the second end of said manual crank unit, and having a third quick-disconnect latch member thereon which mates with said first quick-disconnect latch member to selectively and rotatably support said manual crank unit on said bed frame, whereby even relatively unskilled personnel without tools can remove said motor drive unit from said bed for off-site repair, and replace the same with said manual crank unit to insure uninterrupted operation of said bed, without disturbing the patient.

2. An adjustable bed as set forth in claim 1, wherein:

said first quick-disconnect latch member is located on an exterior, marginal portion of said bed frame to facilitate removal and replacement of said motor drive unit and said manual crank unit.

3. An adjustable bed as set forth in claim 2, wherein:

said bed frame marginal portion includes a head section, a foot section, and opposite side sections; and said first quick-disconnect latch member is located on an exterior side of said frame foot section.

4. An adjustable bed as set forth in claim 3, wherein:

said second and third coupling members include means for telescopingly connecting the same with said controller shaft, whereby the first ends of said motor drive unit and said manual crank unit are supported on said bed frame by said controller shaft.

5. An adjustable bed as set forth in claim 4, wherein said first quick-disconnect latch member comprises:

an aperture extending through a vertical wall portion of said frame foot section, said aperture being shaped to receive said second and third quick-disconnect latch members therein, and including at least one radially oriented slot; and at least one pair of laterally spaced apart stops protruding outwardly from the exterior side of the vertical wall portion of said frame foot section, and positioned a spaced apart, angular measure from said slot to form a snap lock with said second and third quick-disconnect latch members.

6. An adjustable bed as set forth in claim 5, wherein said second quick-disconnect latch member comprises:

a first lock bushing rotatably mounted on the second end of said motor drive unit, and including a cylindrically-shaped body, with at least one ear protruding radially outwardly therefrom; said ear being shaped for longitudinal insertion into said slot, and having a radially extending notch, which has a width slightly greater than the thickness of the vertical wall portion of said frame foot section, and divides said ear into forward and rearward halves, whereby to lock said motor drive unit onto said bed frame, said first lock bushing is rotated until the forward half of said first lock bushing ear is positioned between said stops to define said snap-lock.

7. An adjustable bed as set forth in claim 6, wherein said third quick-disconnect latch member comprises:

a second lock bushing rotatably mounted on the second end of said manual crank unit, and including a cylindrically-shaped body with at least one ear protruding radially outwardly therefrom; said second lock bushing ear being shaped for longitudinal insertion into said slot, and having a radially extending notch, which has a width slightly greater than the thickness of the vertical wall portion of said frame foot section, and divides said second lock bushing ear into forward and rearward halves, whereby to lock said manual crank unit onto said bed frame, said second lock bushing is rotated until the forward half of said second lock bushing ear is positioned between said stops to define said snap lock.

8. An adjustable bed as set forth in claim 7, wherein:

said aperture includes a second radially oriented slot, shaped substantially indentical to said first named slot; said first and second slots being located on diametrically opposite sides of said aperture.

9. An adjustable bed as set forth in claim 8, including:

a second pair of stops protruding outwardly from the exterior side of the vertical wall portion of said frame foot section, and positioned in alignment with said first named pair of stops.

10. An adjustable bed as set forth in claim 9, wherein:

said first lock bushing includes a second, radially protruding ear, shaped substantially identical to said first named ear; said first and second ears being located on diametrically opposite sides of said first lock bushing body.

11. An adjustable bed as set forth in claim 10, wherein:

said second lock bushing includes a second, radially protruding ear, shaped substantially identical to said first named, second bushing ear; said first and second ears being located on diametrically opposite sides of said second lock bushing body.

12. An adjustable bed as set forth in claim 11, wherein:

said first coupling member comprises a keyway extending parallel with the longitudinal axis of said controller shaft;

said second coupling member comprises a tubular sleeve shaped for close reception on said controller shaft, with a spline configured for mating reception in said keyway; and said third coupling member comprises a tubular terminal portion of the first end of said manual crank unit, which is shaped for close reception on said controller shaft, and includes a key configured for mating reception in said keyway.

13. An adjustable bed as set forth in claim 12, wherein:

said means for preventing relative rotation between said motor drive unit and said bed frame comprises:

a stud protruding outwardly from the first end of said motor drive unit; said stud being oriented generally parallel with said output shaft, and spaced laterally therefrom; and a socket located in said bed frame, and shaped to receive said stud therein, whereby the first ends of both said motor drive unit and said manual crank unit are connected with said bed frame by longitudinal insertion onto said controller shaft.

14. An adjustable bed as set forth in claim 13, wherein:

said first and second lock bushings are constructed of a self-lubricating, resilient material; and said stops comprise hemispherically-shaped knobs.

15. An adjustable bed as set forth in claim 14, wherein:

said manual crank unit comprises a cylindrically-shaped, straight, tube, having a substantially uniform cross-sectional shape which permits said tube to be inserted through said aperture from the exterior side of said foot frame section.

16. An adjustable bed as set forth in claim 15, wherein:

said manual crank unit includes means for detachably mounting said handle thereon.

17. An adjustable bed as set forth in claim 16, including:

means for electrically insulating said motor drive unit from said bed frame.

18. An adjustable bed as set forth in claim 17, wherein:

said bed includes multiple controller shafts to manipulate different, adjustable portions of said bed; and multiple motor drive units and manual crank units are provided to connect interchangeably with said multiple controller shafts.

19. An adjustable bed as set forth in claim 18, wherein:

said bed frame includes a transverse cross brace extending between said opposite side sections, and disposed at a medial portion of said bed frame;

said controller shafts protrude from said frame cross brace toward the foot section of said bed frame.

20. An adjustable bed as set forth in claim 19, wherein:

said first lock bushing is inserted into an associated aperture from an interior side of said frame foot section, and includes a stop to longitudinally position said motor drive unit for connection with an associated one of said controller shafts.

21. An adjustable bed as set forth in claim 20, wherein:

said second lock bushing includes a stop to longitudinally position said manual crank unit for connection with an associated one of said controller shafts.

22. An adjustable bed as set forth in claim 21, wherein:

said drive units include hollow tubular support arms to mount the same between the cross brace and foot section of said bed frame.

23. An adjustable bed as set forth in claim 22, including:

an emergency crank shaped for telescoping insertion into said hollow support arms, and including means for releasably engaging auxiliary shaft portions of said motor drive units with said emerging crank to manually manipulate the adjustable portions of said bed driven by a motor drive unit, without removing the motor drive unit from said bed.

24. An adjustable bed as set forth in claim 1, wherein:

said second and third coupling members include means for telescopingly connecting the same with said controller shaft, whereby the first ends of said motor drive unit and said manual crank unit are supported on said bed frame by said controller shaft.

25. An adjustable bed as set forth in claim 1, wherein said first quick-disconnect latch member comprises:

an aperture extending through a vertical wall portion of said frame; said aperture being shaped to receive said second and third quick-disconnect latch members therein, and including at least one radially oriented slot; and at least one pair of laterally spaced apart stops protruding outwardly from an exterior side of the vertical wall portion of said frame, and positioned a spaced apart, angular measure from said slot to form a snap-lock with said second and third quick-disconnect latch members.

26. An adjustable bed as set forth in claim 25, wherein said second quick-disconnect latch member comprises:

a first lock bushing rotatably mounted on the second end of said motor drive unit, and including a cylindrically-shaped body with at least one ear protruding radially outwardly therefrom; said ear being shaped for longitudinal insertion into said slot, and having a radially extending notch which has a width slightly greater than the thickness of the vertical wall portion of said frame, and divides said ear into forward and rearward halves, whereby to lock said motor drive unit onto said bed frame, said first lock bushing is rotated until the forward half of said first lock bushing ear is positioned between said stops to define said snap-lock.

27. An adjustable bed as set forth in claim 25, wherein said third quick-disconnect latch member comprises:

a second lock bushing rotatably mounted on the second end of said manual crank unit, and including a cylindrically-shaped body with at least one ear protruding radially outwardly therefrom; said second lock bushing ear being shaped for longitudinal insertion into said slot, and having a radially extending notch, which has a width slightly greater than the thickness of the vertical wall portion of said frame, and divides said second lock bushing ear into forward and rearward halves, whereby to lock said manual crank unit on said bed frame, said second lock bushing is rotated until the forward half of said second lock bushing ear is positioned between said stops to define said snap-lock.

28. An adjustable bed as set forth in claim 1, wherein:

said first coupler member comprises a keyway located in said controller shaft, and extending parallel with the longitudinal axis thereof;

said second coupling member comprises a tubular sleeve shaped for close reception onto said controller shaft, with a spline configured for mating reception in said keyway; and said third coupling member comprises a tubular terminal portion of the first end of said manual crank unit, which is shaped for close reception onto said controller shaft, and includes a key configured for mating reception in said keyway.

29. An adjustable bed as set forth in claim 1, wherein said means for preventing relative rotation between said motor drive unit and said bed frame comprises:

a stud protruding outwardly from the first end of said motor drive unit; said stud being oriented generally parallel with said output shaft, and being spaced laterally therefrom; and a socket located in said bed frame, and shaped to receive said stud therein.

30. An adjustable bed as set forth in claim 1, wherein:

said manual crank unit comprises a cylindrically shaped, straight tube, having a substantially uniform cross-sectional shape, which permits said tube to be inserted through said aperture from the exterior side of said foot frame section.

31. An adjustable bed as set forth in claim 1, wherein: said manual crank unit includes means for detachably mounting said handle thereon.

32. An adjustable bed as set forth in claim, 1 wherein: said bed includes multiple controller shafts to manipulate different, adjustable portions of said bed; and multiple motor drive units and manual crank units are provided to connect interchangeably with said multiple controller shafts.

33. An adjustable bed as set forth in claim 1, wherein: said bed frame includes a transverse cross brace extending between said opposite side sections, and disposed at a medial portion of said bed frame;

said controller shafts protrude from said frame cross brace toward the foot section of said bed frame.

34. A modular drive arrangement for adjustable beds of the type having a frame, and a controller shaft that is rotated to manipulate an adjustable portion of the bed, said drive arrangement comprising:

a motor drive unit, having first and second ends, with an output shaft protruding from the first end of said motor drive unit;

a first coupling member adapted for connection with the controller shaft of the bed;

a second coupler member located on the output shaft of said motor drive unit, and shaped to mate with said first coupling member to releasably and selectively interconnect the output shaft of said motor drive unit with the controller shaft of the bed and transmit rotary motion therebetween;

means for preventing relative rotation between said motor drive unit and the bed frame during adjustment of the bed;

a first, quick-disconnect latch member adapted for connection with said bed frame;

a second, quick-disconnect latch member located on the second end of said motor drive unit, and shaped to mate with said first quick-disconnect latch member to selectively support said motor drive unit on the bed frame;

a manual crank unit, having first and second ends, with a handle protruding from the second end of said manual crank unit;

a third coupling member located on the first end of said manual crank unit, and shaped to mate with said first coupling member to releasably interconnect said manual crank unit with the controller shaft of the bed and transmit rotary motion therebetween;

a bearing located on the second end of said manual crank unit, and having a third quick-disconnect latch member thereon, which mates with said first quick-disconnect latch member to selectively and rotatably support said manual crank unit on the bed frame, whereby even relatively unskilled personnel without tools can remove said motor drive unit from the bed for off-site repair, and replace the same with said manual crank unit to insure uninterrupted operation of the bed, without disturbing the patient.

35. In an adjustable bed of the type having a frame, a controller shaft that is rotated to manipulate an adjustable portion of said bed, and a drive unit to rotate said controller shaft, the improvement of a quick-disconnect mounting arrangement for said drive unit, comprising:

a coupling connected with one end of said drive unit, and having a socket in which said controller shaft is closely received, thereby supporting the one end of said drive unit on said bed frame; said coupling and said controller shaft including a key arrangement which rotatably interconnects the one end of said drive unit with said controller shaft to transmit rotary motion therebetween;

a quick-disconnect latch releasably connecting the opposite end of said drive unit with a foot portion of said bed frame; said latch comprising:

an aperture extending through a vertical wall portion of said frame foot portion, and including at least one radially oriented slot;

at least one pair of laterally spaced apart stops protruding outwardly from an exterior side of the vertical wall portion of said frame foot section, and positioned a spaced apart, angular measure from said slot;

a lock bushing rotatably mounted on the opposite end of said drive unit, and including a cylindrically-shaped body with at least one ear protruding radially outwardly therefrom; said ear being shaped for longitudinal insertion into said slot, and having a radially extending notch, which has a width slightly greater than the thickness of the vertical wall portion of said frame foot section, and divides said ear into forward and rearward halves, whereby to lock said drive unit on said bed frame, said lock bushing is rotated until the forward half of said lock bushing ear is positioned between said stops to define a snap lock which can be easily operated by even relatively unskilled personnel without tools to remove and replace said drive unit.

* * * * *

UNITED STATES PATENT AND TRADEMARK OFFICE

CERTIFICATE OF CORRECTION

PATENT NO. : 4,545,084

DATED : October 8, 1985

INVENTOR(S) : Warren J. Peterson

It is certified that error appears in the above-identified patent and that said Letters Patent is hereby corrected as shown below:

Column 7, line 1:
"87" should be --88--;

Column 7, line 13:
"87" should be --88--;

Column 7, line 20:
"86" should be --88--;

Column 7, line 37:
"87" should be --88--;

Column 7, line 43:
"87" should be --88--;

Column 7, line 50:
"87" should be --88--;

Column 8, line 1:
"87" should be --88--;

Column 8, line 5:
"87" should be --88--;

Column 8, line 9:
"out" should be --outer--;

Column 8, line 23:
"auxillary" should be --auxiliary--;

UNITED STATES PATENT AND TRADEMARK OFFICE

CERTIFICATE OF CORRECTION

PATENT NO. : 4,545,084

DATED : October 8, 1985

INVENTOR(S) : Warren J. Peterson

It is certified that error appears in the above-identified patent and that said Letters Patent is hereby corrected as shown below:

Column 8, line 28:
"auxillary" should be --auxiliary--;

Column 8, line 32:
"auxillary" should be --auxiliary--;

Column 8, line 44:
"lock bushing 11" should be --lock bushing body 11--;

Column 8, line 54:
"87" should be --88--;

Column 8, line 68:
"about" should be --abut--;

Column 9, line 39:
"87" should be --88--;

UNITED STATES PATENT AND TRADEMARK OFFICE

CERTIFICATE OF CORRECTION

PATENT NO. : 4,545,084

DATED : October 8, 1985

INVENTOR(S) : Warren J. Peterson

It is certified that error appears in the above-identified patent and that said Letters Patent is hereby corrected as shown below:

Column 14, Claim 28, Line 2:
"coupler" should be --coupling--;

Column 15, Claim 34, Line 31:
"coupler" should be --coupling--.

Signed and Sealed this

*Twenty-second* Day of *April 1986*

[SEAL]

*Attest:*

DONALD J. QUIGG

*Attesting Officer*

*Commissioner of Patents and Trademarks*